US007201677B1

(12) United States Patent
Hellerson

(10) Patent No.: US 7,201,677 B1
(45) Date of Patent: Apr. 10, 2007

(54) TENNIS NET WINDER

(75) Inventor: Robert K. Hellerson, Lakewood, NJ (US)

(73) Assignee: J.A. Cissel Mfg. Co., Lakewood, NJ (US)

( * ) Notice: Subject to any disclaimer, the term of this patent is extended or adjusted under 35 U.S.C. 154(b) by 0 days.

(21) Appl. No.: 11/429,603

(22) Filed: May 8, 2006

(51) Int. Cl.
*A63B 61/02* (2006.01)

(52) U.S. Cl. ..... 473/493

(58) Field of Classification Search ..... 473/490, 473/492–494

See application file for complete search history.

(56) References Cited

U.S. PATENT DOCUMENTS 1,023,928 A * 4/1912 Edwards ..... 473/494
1,940,595 A * 12/1933 Johnson ..... 473/493
4,122,451 A * 10/1978 Senoh ..... 473/492
4,776,588 A * 10/1988 Crowley ..... 473/493
5,308,085 A * 5/1994 Koole ..... 473/493
6,248,030 B1 * 6/2001 Pierce ..... 473/493
6,800,043 B1 * 10/2004 Pohrer ..... 473/493

FOREIGN PATENT DOCUMENTS

DE 3523568 A1 * 1/1987

* cited by examiner

*Primary Examiner*—Raleigh W. Chiu
(74) *Attorney, Agent, or Firm*—Clifford G. Frayne

(57) ABSTRACT

A tennis net winder for positioning within a tennis net support post, the tennis net winder comprising a frame having a face plate, having a plurality of apertures for securing the tennis net winder to the support post, the face plate having rearwardly extending support walls secured by a rear wall, the rear wall and face plate having aligned apertures for support of a worm gear member, the extending support walls having aligned apertures for support of a beveled gear and take up drum assembly, the face plate having a generally longitudinal rectangular opening aperture having a guide roller slidably mounted on a cross bar, the tennis net cable passing under the guide roller and through the take up drum, the take up drum being formed with a helical groove such that operation of the worm gear by a crank handle takes up or releases cable on the take up drum, the take up assembly, the winder assembly and frame being coated with a weather impervious coating, such as gold plating.

9 Claims, 5 Drawing Sheets

TENNIS NET WINDER

BACKGROUND OF THE INVENTION

1. Field of the Invention

The present invention relates to a tennis net winder, and in particular, to an improved tennis net winder constructed to withstand the harmful affects of the elements and of weather and presents a positive winding mechanism to withstand the tension placed on it by the net cable.

2. Description of the Prior Art

A tennis net is strung between two upstanding posts, the upstanding posts being firmly embedded in the underlying strata. The tennis net is supported by a cable which runs through a hem in the upper edge of the tennis net, one end of the cable being fixedly secured to one post and the opposing end of the cable being secured to a winch or winder. The winder allows for the selective tension of the cable in order to position the top edge of the tennis net at the correct height for either recreational or competitive play. The winch or winder also allows for the tension to be released from the cable for removing the tennis net when required, such as on grass or clay courts where this occurs at least daily since the court surface must be cut, rolled or manicured.

For many years, the winch or winder was bolted to the exterior surface of one of the tennis posts, and as such, was exposed to weather elements, and hence would oftentimes rust or seize up and lose its mechanical advantage. Further, with the winch or winder mechanism on the exterior of the support pole it presented a possible injurious situation to players rushing the net or to young children since the gear and ratchet mechanism were exposed. Therefore, steps were taken to position the winder mechanism within the support pole with only the winder socket extending from the support post for selective engagement with a removable crank handle. This afforded the winch or winder mechanism slightly more protection from the weather than being mounted exterior to the post, but nevertheless still subjected the winch or winder to the elements. One solution was to fabricate the winder mechanism from a bronze or brass alloy so as to minimize the effect of the weather on the mechanism. The change in material accomplished the task of minimizing the weather effects on the winch or winder, however, the alloy mechanism in conjunction with the design utilized to allow positioning within the support post did not provide the required strength when attempting to retain the required tension on the cable, since a typical tension on a tennis net is from 400 to 450 pounds. The alloy mechanisms would therefore require the frequent replacement of mechanical parts.

Therefore there was a need to fabricate a winder of sufficient strength to deal with the stress of the cable tensioning and to be fabricated in such a manner that the winch or winder mechanism was impervious to the weather elements.

OBJECTS OF THE INVENTION

An object of the present invention is to provide for a novel winder mechanism for a tennis net assembly, the winder mechanism capable of withstanding tension stress of the cable tensioning of the tennis net.

Another object of the present invention is to provide for a novel winder assembly for a tennis net assembly wherein the winder assembly is coated to protect the components of the mechanical assembly from the elements.

A still further object of the present invention is to provide for a novel winder assembly for a tennis net assembly which provides for a positive securing means for the cable tensioning.

A still further object of the present invention is to provide for a novel winder assembly for a tennis net assembly in which the cable is guided onto the cable take up drum.

SUMMARY OF THE INVENTION

A tennis net winder for positioning within a tennis net support post, the tennis net winder comprising a frame having a face plate, having a plurality of apertures for securing the tennis net winder to the support post, the face plate having rearwardly extending support walls secured by a rear wall, the rear wall and face plate having aligned apertures for support of a worm gear member, the extending support walls having aligned apertures for support of a beveled gear and take up drum assembly, the face plate having a generally longitudinal rectangular opening aperture having a guide roller slidably mounted on a cross bar, the tennis net cable passing under the guide roller and through the take up drum, the take up drum being formed with a helical groove such that operation of the worm gear by a crank handle takes up or releases cable on the take up drum, the take up assembly, the winder assembly and frame being coated with a weather impervious coating, such as gold plating.

BRIEF DESCRIPTION OF THE DRAWINGS

These and other objects of the present invention will become apparent, particularly when taken in light of the following illustrations wherein.

DETAILED DESCRIPTION OF THE INVENTION

Figure 1:
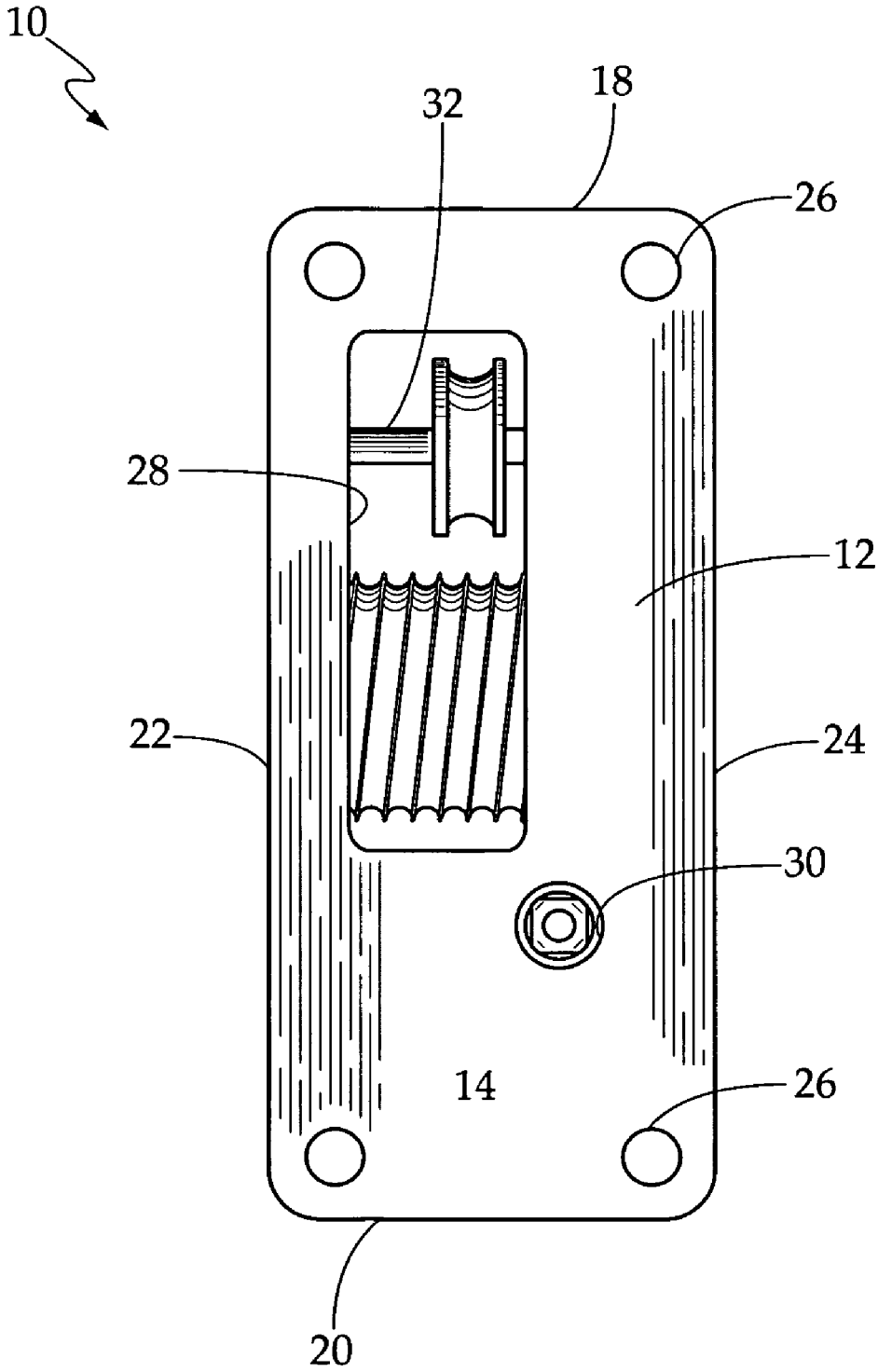
FIG. 1 is a front view of the support assembly of the present invention.
Figure 3:
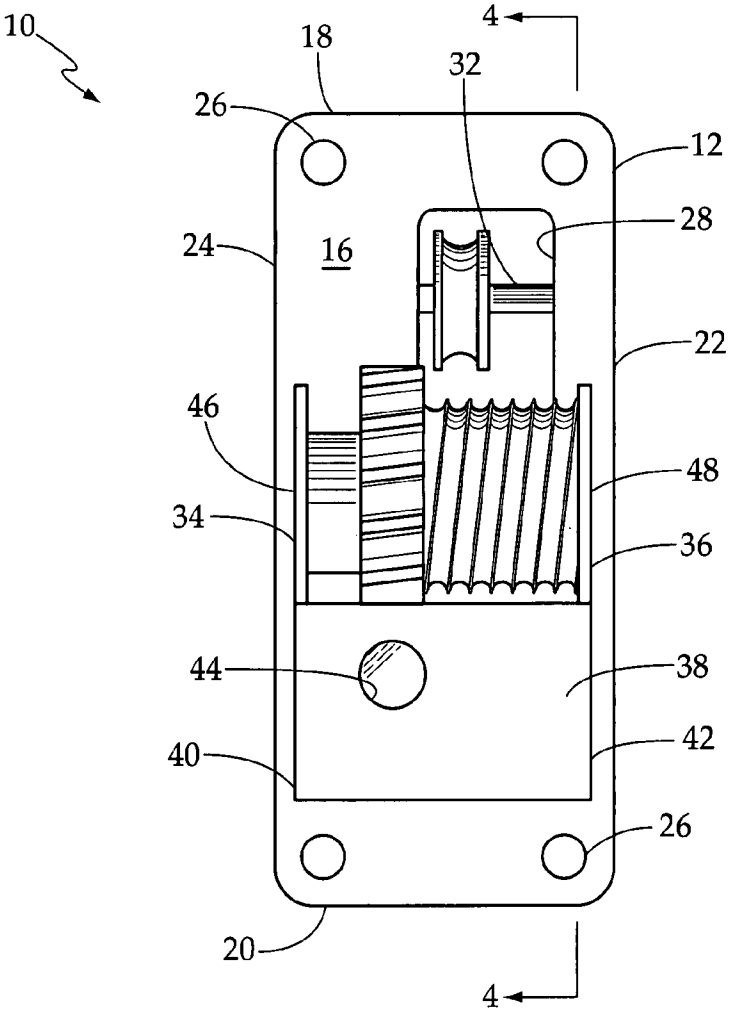
FIG. 3 is a rear view of the support assembly of the present invention.
Figure 2:
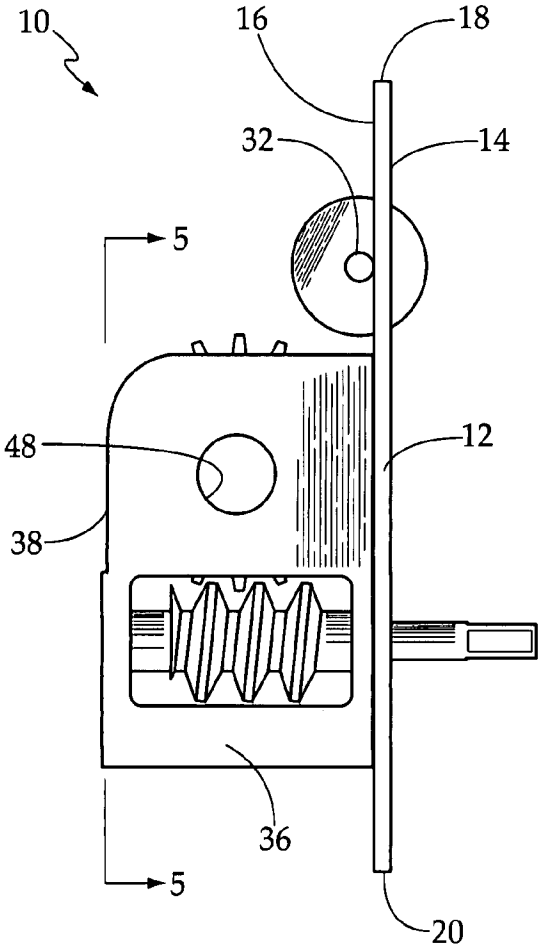
FIG. 2 is a side view of the support assembly of the present invention.
Figure 6:
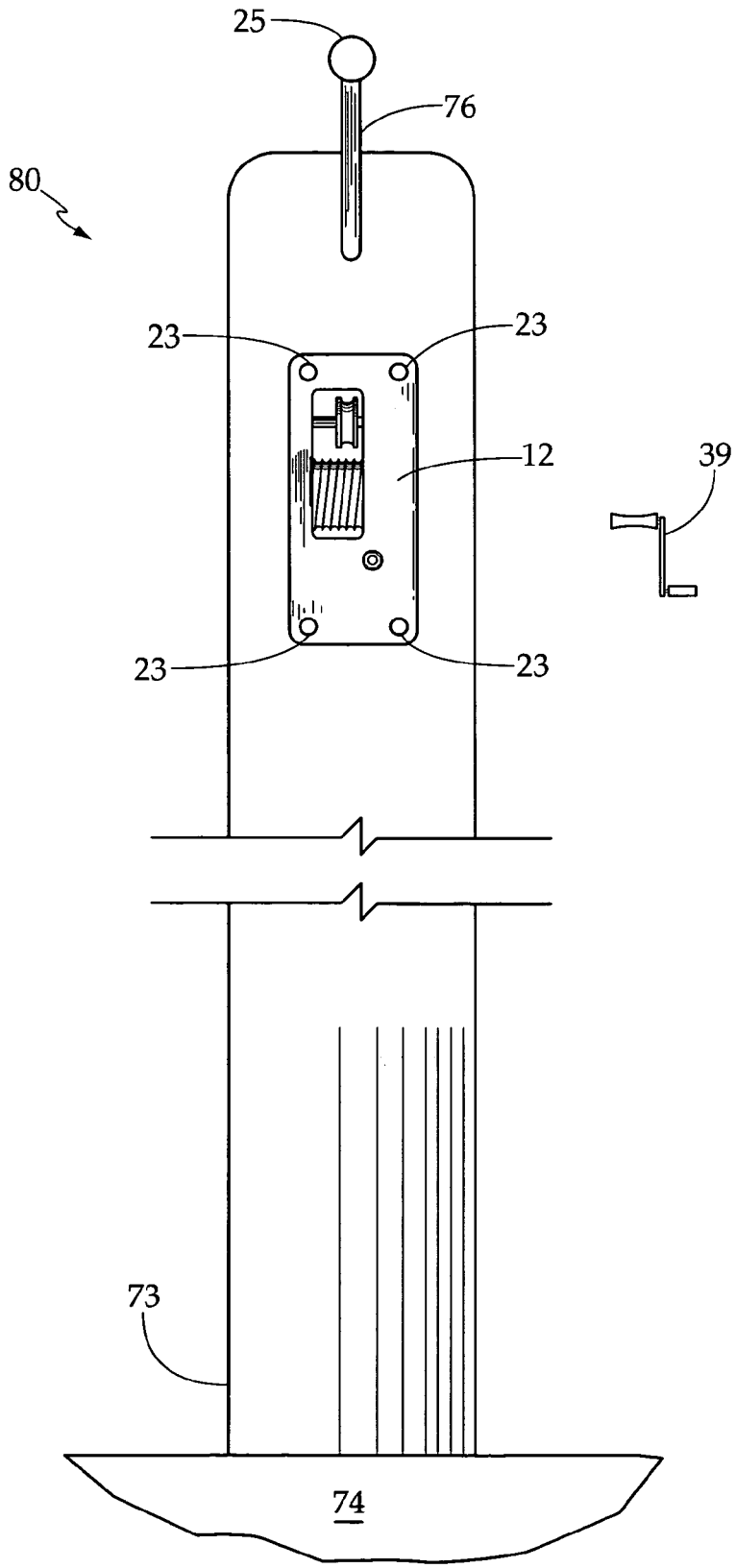
FIG. 6 is a front view of a tennis net support post with the support and winder mechanism installed.

FIG. 1 is a front view of a support assembly for the winder mechanism, FIG. 2 is a side view of the support assembly, and FIG. 3 is a rear view of the support assembly. The support assembly 10 comprises a face plate 12 having a front face 14 and a rear face 16. It is generally formed with parallel short upper and lower peripheral edges 18 and 20 and longer longitudinal peripheral edges 22 and 24. The face plate 12 is formed with four corner apertures 26 for receipt of threaded fasteners 23 to secure the support assembly and winder mechanism within a support post (FIG. 6). A rectangular aperture 28 in vertical orientation is formed in face plate 12 to allow for the passage and gathering of support cable 25 for the tennis net as described hereafter. Another aperture 30 is formed in face plate 12 to allow a crank pin secured to a worm gear to extend through face plate 12 and be engaged by a crank handle as described hereafter.

Referring to side view FIG. 2 and rear view FIG. 3, it can be seen that there is secured to the rear face 16 of face plate 12 a cross bar 32 positioned proximate the top of rectangular aperture 28 for support of a guide wheel as described hereafter. Crossbar 32 is secured to the rear face 16 by any suitable method, preferably spot welding.

Further secured to rear face 16 are a pair of opposing vertical support walls 34 and 36, generally perpendicular to the rear face and secured thereto again by a suitable securing means, preferably spot welding. Opposing vertical support walls 34 and 36 are further secured to each other by means of a rear support wall 38 parallel to face plate 12 and secured to the lower rear edges 40 and 42 of opposing vertical support walls 34 and 36. Rear support wall 38 which is parallel to face plate 12 is formed with an aperture 44 there through in alignment with aperture 30 in face plate 12 in order to rotatably receive a worm gear described hereafter. Similarly, opposing vertical support walls 34 and 36 are formed with aligned apertures 46 and 48 there through to rotatably receive a gear and take up drum mechanism as described hereafter.

Figure 5:
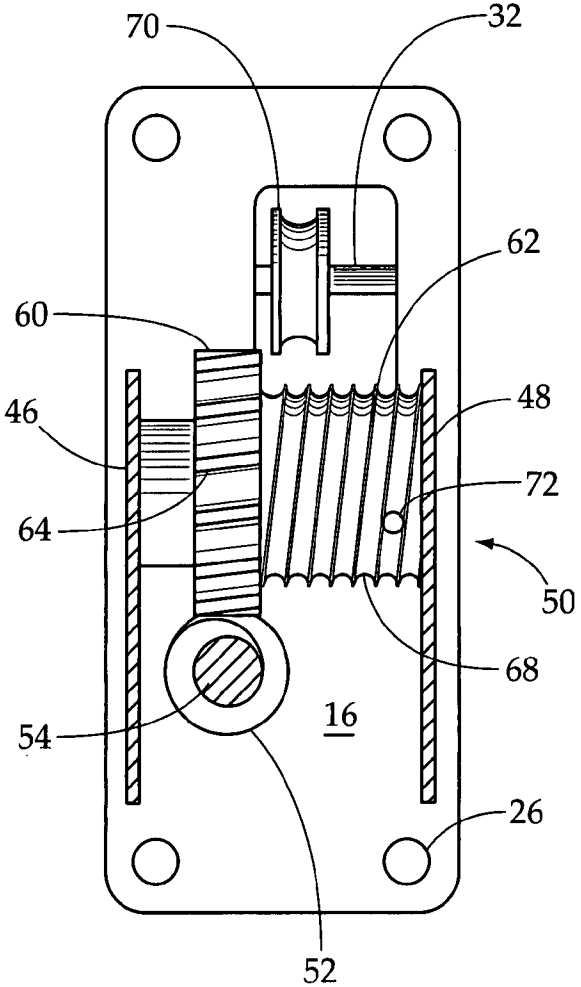
FIG. 5 is a cutaway view of FIG. 2 along Plane 5—5 illustrating the gearing mechanism within the support assembly.
Figure 4:
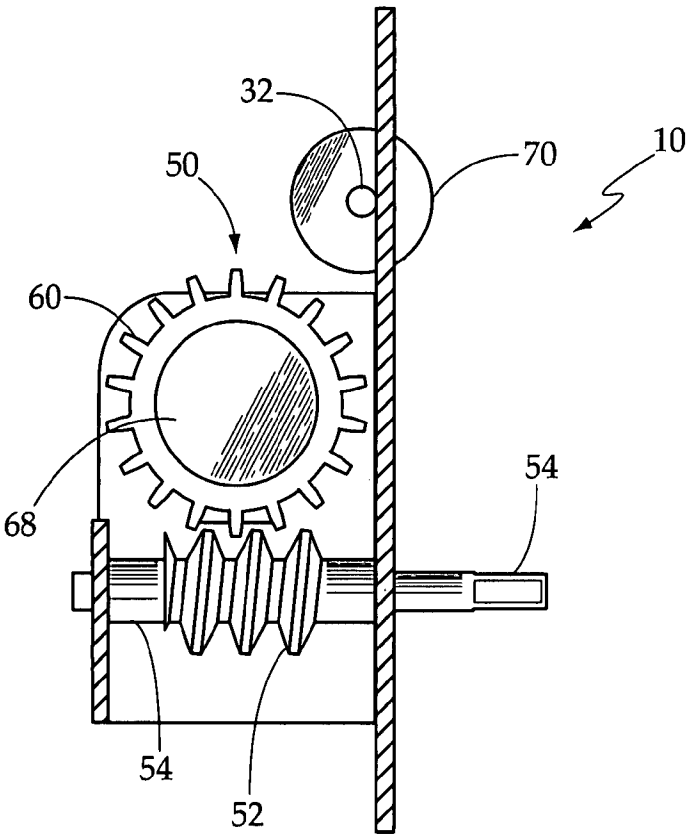
FIG. 4 is a cutaway view of FIG. 3 along Plane 4—4 illustrating the gearing mechanism within the support assembly.

FIG. 4 is a side cutaway view of FIG. 3 along plane 4—4 illustrating the support assembly 10 with the winder mechanism generally identified as 50 positioned therein, and FIG. 5 is a cutaway view of FIG. 2 along Plane 5—5 illustrating the winder mechanism.

The winder mechanism 50 comprises a worm gear 52 pin mounted on shaft 54, the diameter of which equals apertures 30 and 44. The diameter of worm gear 52 is greater than that of apertures 30 and 44 in face plate 12 and rear support wall 38 which maintains the worm gear in position. The end of worm gear support shaft 54 extending through face plate 12 is squared to slidably received a crank handle 39 to adjust tension on the net.

Positioned above worm gear 52 and journaled into apertures 46 and 48 in vertical support walls 34 and 36 is a unitary gear 60 and take up drum member 62. Gear 60 has angled gear cogs 64 of larger size that the prior art and complimentary with the pitch of worm gear 52 such that rotation of the crank handle rotates worm gear 52 and in turn rotates gear 60 and take up drum 62. Take up drum 62 is smaller than the prior art and is formed with helical groove 68 to insure tangle free take up and release of tension on the net cable. This is accomplished by having mounted on cross bar 32, a grooved guide roller 70 on which the net cable passes. Grooved guide roller 70 is initially positioned to its left most position as one faces the face plate 12 so that the cable take up on the grooves 68 of take up drum 62 will move from left to right as one views the face plate 12 from the front. Grooved guide roller 70 slides freely on cross bar 32 and under the influence of the take up of the cable or the release of the cable will slide either left or right. Take up drum 62 is further formed with an aperture 72 there through which allows the net cable to be positively inserted through the take up drum 62 so that it does not cause slippage.

The positioning of vertical support walls 34 and 36 and rear support wall 38 to the rear face 16 of face plate 10 increases the structural integrity of the tennis net winder by providing more positive and additional support for worm gear 52 and gear 60 and take up drum 62. The structural integrity is further enhanced by constructing the tennis net winder from hardened steel as opposed to bronze alloy. The entire mechanism, including gears, shafts, face plate and support walls, are further improved by plating the surfaces with gold or other suitable coatings thereof to protect them from the weather.

FIG. 6 is a front view of a typical tennis support post 80. It is formed with a lower end 73 embedded in a strata 74 and an upper end which is formed with a guide roller 76 over which the tennis support cable 25 passes. The support assembly 10 and winding mechanism 50 including face plate 12 is secured within the support post by fasteners 23.

The tennis net cable 25 would slide over guide roller 76, and under guide roller 70 and be inserted through the aperture 72 in take up drum 62.

The end of worm gear support shaft 54 which extends through face plate 12 by means of aperture 30 can be engaged by crank handle 39 to increase or lessen the tension on the tennis net support cable 25.

Figure 7:
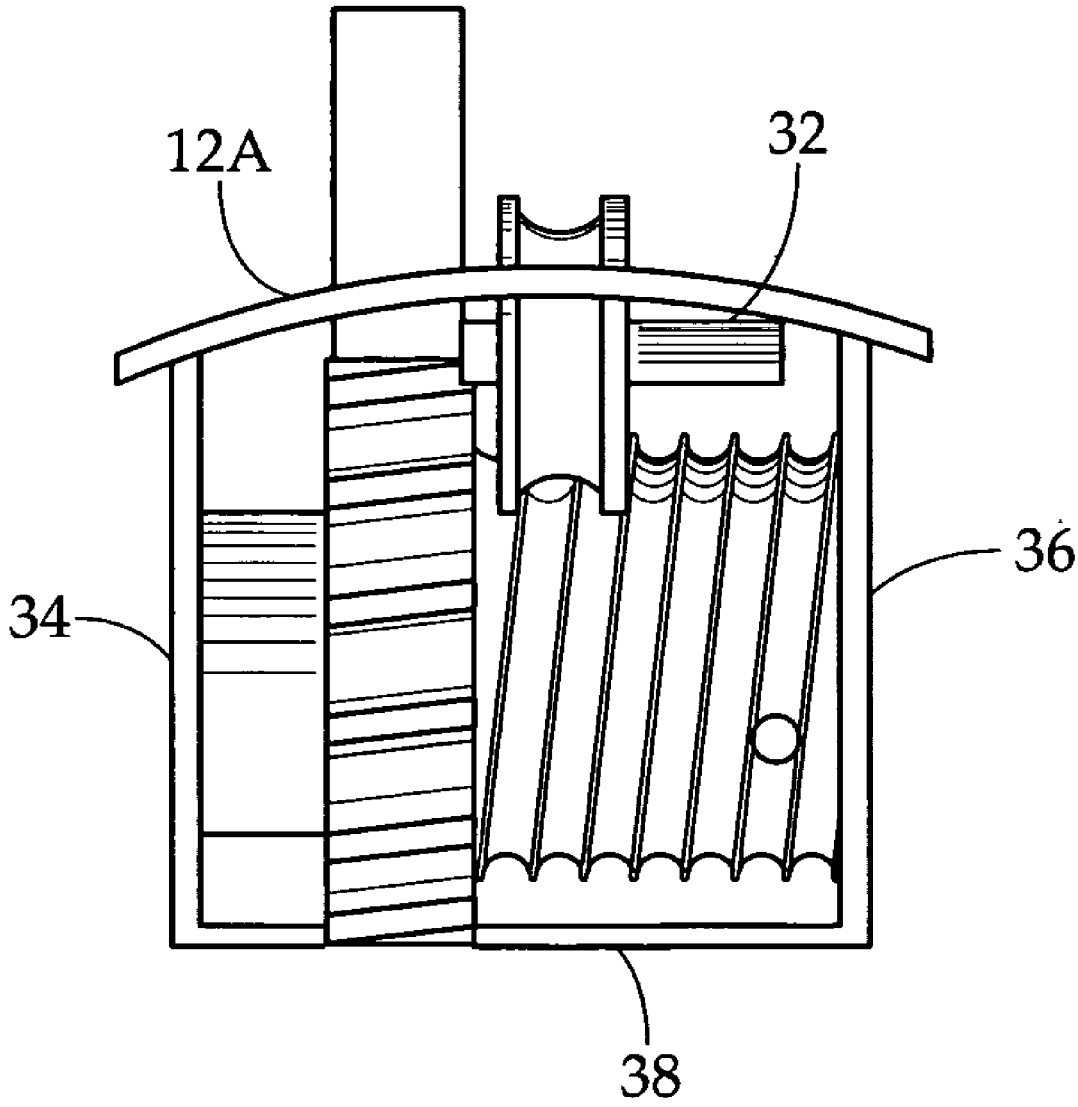
FIG. 7 is a top view of the support mechanism adapted to a tennis support post which is circular in cross section.

The present embodiment has been illustrated with respect to a tennis net winder which would be disposed and secured within a post having a square or rectangular cross section. For those support posts having a circular cross section, the same structure and function would apply with the exception that the face plate 12A as illustrated in FIG. 7 would be arcuate in order to conform to the curvature of the circumference of the support posts and that the opposing vertical support walls 34 and 36 would still be parallel with each other, but would no longer be perpendicular to the rear face of the arcuate face plate 12A.

While the present invention has been described with respect to the exemplary embodiments thereof, it will be recognized by those of ordinary skill in the art that many modifications or changes can be achieved without departing from the spirit and scope of the invention. Therefore it is manifestly intended that the invention be limited only by the scope of the claims and the equivalence thereof.

I claim:

1. A tennis net winder assembly for positioning within a tennis net support post, said tennis net support post having a lower end embedded in a support strata and an upper end having a guide roller for the passage there over of a tennis net support cable, said tennis net winder assembly comprising:

a face plate member having a front face and a rear face and a plurality of apertures about its periphery for the passage of securing means to secure said face plate member to said tennis net support post, said face plate member further having a generally centrally disposed aperture for the passage there through of said tennis net support cable for communication and affixation to a winder assembly;

a pair of generally vertical support walls secured to said rear face of said face plate member and secured at their second end by a rear wall, said vertical support walls having aligned apertures there through for rotatable support of a portion of said tennis net winder assembly, said rear wall and said face plate member having aligned apertures for the rotatable receipt of a portion of a tennis net winder assembly;

a winder mechanism disposed between said face plate member, said vertical support walls and said rear wall, said winder mechanism comprising a worm gear rotatably mounted on a shaft between said rear wall and said face plate member, said shaft rotatably mounted in said aligned apertures in said rear wall and said face plate member, a portion of said shaft extending outwardly from said front face of said face plate for engagement with a hand crank;

said winder mechanism further including a vertically oriented gear having beveled gear teeth cooperative with said worm gear, and a take up drum unitarily formed with said vertically oriented gear, rotatably positioned on a second shaft between said vertical support walls in said aligned apertures formed in said vertical support walls;

a cross member secured across said generally rectangular opening in said face plate, and secured to said rear face, said cross member having positioned thereon a freely slidable grooved guide roller positioned above said take up drum, said guide roller for helically directing said tennis net support cable onto and off of said take up drum.

2. The tennis net winder assembly in accordance with claim 1 wherein said take up drum is helically grooved for the receipt of tennis net support cable.

3. The tennis net winder assembly in accordance with claim 1 wherein said take up drum is formed with an aperture there through to secure the end of said tennis net support cable.

4. The tennis net winder assembly in accordance with claim 1 wherein said shaft extending through said face plate member of said tennis net winder assembly is squared at its end for cooperation with a hand crank for increasing or decreasing the tension on said tennis net support cable.

5. The tennis net winder assembly in accordance with claim 1 wherein said tennis net winder assembly is constructed of hardened steel.

6. The tennis net winder assembly in accordance with claim 5 wherein said tennis net winder is gold plated for protection from the elements.

7. The tennis net winder assembly in accordance with claim 5 wherein tennis net winder is sprayed with a layer of weather impervious coating.

8. The tennis net winder assembly in accordance with claim 1 wherein face plate member is planar for insertion into a tennis net support post having a square cross section.

9. The tennis net winder assembly in accordance with claim 1 wherein said face plate member is arcuate for insertion and securing to a tennis support post which is circular in cross section.

* * * * *